US007325434B2

(12) United States Patent
Esaki et al.

(10) Patent No.: US 7,325,434 B2
(45) Date of Patent: Feb. 5, 2008

(54) METHOD FOR MANUFACTURING RING-SHAPED MAGNET MATERIAL AND MANUFACTURING APPARATUS USED THEREFOR

(75) Inventors: Junichi Esaki, Aichi (JP); Sachihiro Isogawa, Aichi (JP); Takashi Sako, Aichi (JP)

(73) Assignee: Daido Tokushuko Kabushiki Kaisha, Nagoya-shi (JP)

( * ) Notice: Subject to any disclaimer, the term of this patent is extended or adjusted under 35 U.S.C. 154(b) by 136 days.

(21) Appl. No.: 11/216,927

(22) Filed: Aug. 31, 2005

(65) Prior Publication Data

US 2006/0042342 A1 Mar. 2, 2006

(30) Foreign Application Priority Data

Sep. 1, 2004 (JP) ..... 2004-254470
Aug. 22, 2005 (JP) ..... 2005-239699

(51) Int. Cl.
*B21D 22/00* (2006.01)
*B21D 31/00* (2006.01)
*B21C 3/00* (2006.01)

(52) U.S. Cl. ..... 72/343; 72/364; 72/467

(58) Field of Classification Search ..... 72/343, 72/264, 265, 268, 467; 148/120
See application file for complete search history.

(56) References Cited

U.S. PATENT DOCUMENTS 3,255,621 A * 6/1966 Ohsol ..... 72/467
3,362,208 A * 1/1968 Murphy et al. ..... 72/265
4,579,607 A 4/1986 Ibata et al.
4,623,404 A 11/1986 Ibata et al.
4,648,915 A * 3/1987 Ibata et al. ..... 148/101
4,653,305 A * 3/1987 Kanamaru et al. ..... 72/343
4,960,469 A 10/1990 Tanigawa et al.

FOREIGN PATENT DOCUMENTS

JP 09-129463 A 5/1997

* cited by examiner

*Primary Examiner*—Derris H. Banks
*Assistant Examiner*—Teresa M. Bonk
(74) *Attorney, Agent, or Firm*—Frishauf, Holtz, Goodman & Chick, P.C.

(57) ABSTRACT

A method for manufacturing a ring-shaped magnet includes arranging, in a penetrating hole formed in a die, a mandrel having a cylinder tip portion of a diameter $d_1$, a cylinder base end portion of a diameter $d_2$, provided $d_1<d_2$, and a taper portion positioned between the cylinder tip portion and the cylinder base end portion. The penetrating hole includes a first penetrating hole portion of a diameter $D_1$, a second penetrating hole portion of a diameter $D_2$, provided $D_1<D_2$, and a tapered hole portion of a positioned between the first penetrating hole portion and the second penetrating hole portion. The cylinder tip portion is loaded with a preform, and plastic-working is performed on the preform in a gap formed by the penetrating hole and the mandrel by pressing the preform with a pressing punch.

10 Claims, 12 Drawing Sheets

METHOD FOR MANUFACTURING RING-SHAPED MAGNET MATERIAL AND MANUFACTURING APPARATUS USED THEREFOR

BACKGROUND

1. Field of the Invention

The present invention relates to a method for manufacturing a ring-shaped magnet material, and manufacturing apparatus used therefor. More specifically, the invention relates to a method capable of manufacturing a ring-shaped magnet material excellent in magnetic properties continuously or by single taking, with high yield, and also capable of manufacturing with more freedom for design with regard to the required properties, and relates to a manufacturing apparatus used therefor.

2. Prior Art

In an Nd—Fe—B type fully dense permanent magnet, the one caused to have a magnetically radial anisotropic property by extrusion molding in particular is useful as the material for a ring-shaped magnet.

Conventionally, material for such a ring-shaped magnet has been manufactured as follows. First, for example, a melt spun magnetically isotropic ribbon made of a rare earth permanent magnet alloy is crushed into powder, which is cold pressed into a green compact. Then, this green compact is densified by warm-pressing or hot-pressing to thereby make a cylindrical preform with the desired dimensions, for example.

Then, for example, by carrying out backward-extrusion forming to this cylindrical preform in the warm, the crystal axis is orientation-disposed to exhibit a magnetic anisotropy property and at the same time a cup-shaped body having a desired geometry is once formed, and a piercing by means of a perforating punch is carried out to the portion corresponding to the bottom portion of this cup, thereby making an objective ring-shaped magnet material.

In addition, this ring-shaped magnet material is magnetized in the subsequent step, thereby being provided for practical use as the magnet having the radial anisotropy property.

However, because the above-described manufacturing method is a batch system, the productivity thereof is essentially low. Moreover, because the backward-extrusion is applied, a sufficient processing distortion is not applied to the preform in the initial stage of forming, and a tip portion formed in the initial stage will deteriorate in the magnetic properties as compared with the other portions. Therefore, for commercialization of the product, the portion concerned needs to be cut.

Namely, as a loss due to the punching of the bottom portion is also added, the yield of the product becomes extremely low in the above-described manufacturing method.

In order to solve such problems, in Japanese Unexamined Patent Publication No. Hei 9-129463, a method for manufacturing magnet materials is proposed as follows.

In this method, the ring-shaped magnet material is manufactured as follows. As shown in FIG. 1, in a penetrating hole 11A of a die 11 in which the penetrating hole 11A having a constant diameter is formed, a cylindrical mandrel 12 whose tip portion is a flat surface 12*a* and whose diameter is smaller than that of the penetrating hole 11A is arranged. On the top of this mandrel a preform made of magnetic powder is loaded and this preform is pressed with a pressing punch 13. The preform is pressed into a gap formed between the mandrel 12 and the die 11 to be plastic-deformed. Then, as shown in FIG. 1, at the time when the preform is extruded into a cup-shaped body 14', the pressing punch 13 is pulled up, and a new preform of magnetic powder is loaded on the top of the cup-shaped body and presses with the pressing punch 13 again. During the process in which the newly loaded preform is plastic-deformed to be extruded into a new cup-shaped body 14', the upper end of the cup-shaped body in the preceding stage is stuck to the lower end of the newly extruded cup-shaped body 14' and is protruded downward in the penetrating hole 11A while being ring-shaped in the state of being coupled with the new cup-shaped body 14'.

Accordingly, in the case of this manufacturing method, by repeating the above-described operations sequentially, the ring-shaped magnet material 14 is extruded continuously and the productivity thereof is high. In addition, punching the bottom portion, cutting the tip portion and the like, which have been carried out with regard to each magnet material as in the case of the batch system, will not be required and the yield becomes high accordingly.

However, the continuous extruding method of the prior art described above has the following problems.

A first problem is that the coupling portion between the ring-shaped extrusion 14 positioned down below and the new cup-shaped body 14' positioned up above is formed as shown in FIG. 1.

Namely, in the coupling portion the material of the ring-shaped extrusion 14 wraps around from inside to outside along the mandrel 12, and the material of the new cup-shaped body 14' also wraps around from outside to inside along the die 11, and thus the coupling portion will not be a flat end face in which the upper end face of the ring-shaped extrusion 14 and the lower end face of the cup-shaped body 14' intersect at right angles with the longitudinal direction.

For this reason, this part of the coupling portion needs to be cut from the continuous extrusion obtained, and consequently, an advantage that cutting the bottom portion is not required to thereby improve the yield of the product in the batch system will be canceled out.

A second problem is that the freedom for design with regard to the required magnetic properties is extremely narrow.

Generally, if the preform of magnetic material, which is the original material, is processed with a large reduction in area (amount of working), the magnetic properties of the ring-shaped magnet material obtained will be also improved.

However, in case of using this apparatus, if the specification (the outer diameter and inner diameter) for the target product is determined, the diameter of the penetrating hole of the die and the diameter of the mandrel will be determined uniquely. Accordingly, the reduction in area is also determined uniquely. Therefore, if the target geometry is determined, in the first place it is impossible to design the improvement of the magnetic properties by increasing the reduction in area with respect to the original material.

A third problem is that the ring-shaped magnet material manufactured will likely cause a core misalignment.

This is because the mandrel to be arranged in the penetrating hole of the die is relatively long and is used only in the state where the basic end portion thereof is one-point supported with mandrel backup means (not shown). Namely, because the mandrel is in the one-point supported state, the tip portion of the mandrel 12 may oscillate subtlety during the process of loading the preform into the tip portion of the mandrel, of subsequently pressing with the pressing punch 13, or the like. As a result, the core misalignment occurs, thereby deteriorating the dimension accuracy of the product.

A fourth problem is the problem that the magnetic properties of the ring-shaped magnet manufactured are not necessarily high. The demand for the miniaturization and advanced features in the recent electrical and electric equipments has become extremely strong, and in conjunction with this, for example, the magnetic properties on the order of: (BH) max of 400 kJ/$m^3$; Br of 1.45 T; and iHc of 1220 kA/m are required for the ring-shaped magnet to be built into these equipments.

However, in the above-described method of the prior art, it is difficult to manufacture the ring-shaped magnet having such high magnetic properties. For this reason, a new method for manufacturing the ring-shaped magnet capable of enhancing the magnetic properties further is asked for.

OBJECTS AND SUMMARY OF THE INVENTION

The present invention is intended to provide a method for manufacturing a ring-shaped magnet material capable of solving all of the first to third problems described above, and is intended to provide a manufacturing apparatus used therefor.

At the same time, the present invention is intended to provide a method for manufacturing a ring-shaped magnet material, in which method an effective plastic-deformation is carried out to the preform by modifying the relationship of the geometries between the die and the mandrel to thereby resolve also the fourth problem described above, and is intended to provide a manufacturing apparatus used therefor.

In order to achieve the above-described objectives, according to the present invention there is provided a method for manufacturing a ring-shaped magnet material, the method including the steps of:

in a penetrating hole formed in a die, arranging a mandrel having a cylinder tip portion of a diameter $d_1$, a cylinder base end portion of a diameter $d_2$ (provided $d_1<d_2$), and a taper portion of a taper angle $\theta_2$ positioned between the cylinder tip portion and the cylinder base end portion;

loading the cylinder tip portion with a preform from which a ring-shaped magnet material is made, the preform being a circular-ring column shaped body whose inner diameter is $d_1$; and plastic-working the preform in a gap that the penetrating hole and the mandrel form, by pressing the preform with a pressing punch whose inner diameter is $d_1$ and whose outer diameter is the same as that of the penetrating hole;

Then, in the method for manufacturing the ring-shaped magnet material according to the invention, roughly speaking, two manufacturing methods are provided depending on the modes of the penetrating hole of the die to be used.

A first manufacturing method is a manufacturing method using a die in which the diameter of the penetrating hole is a constant value (D, provided $d_2<D$).

A second manufacturing method is a manufacturing method using a die in which the penetrating hole comprises a first penetrating hole of a diameter $D_1$, a second penetrating hole of a diameter $D_2$ (provided $D_1<D_2$), and a tapered hole of the taper angle $\theta_1$ positioned between the first penetrating hole and the second penetrating hole.

In the first manufacturing method, it is preferable that the taper angle $\theta_2$ of the taper portion of the mandrel be within the range of 20° to 80°.

Moreover, in the second manufacturing method, the values of $D_1$, $D_2$, $d_1$, and $d_2$ are set to satisfy the following formulas:

$$d_1<d_2<D_2,$$

$$0<(1-D_1/D_2)\times 100\leqq 70, \text{ and}$$

$$30\leqq(1-(D_2^2-d_2^2)/(D_1^2-d_1^2))\times 100\leqq 94, \text{ and}$$

it is preferable that the taper angle $\theta_1$ of the tapered hole and the taper angle $\theta_2$ of the taper portion satisfy the relationship of $\theta_1<\theta_2$, and $20°\leqq\theta_2\leqq 80°$.

Moreover, in the invention, in order to implement the first manufacturing method described above, there is provided a manufacturing apparatus for a ring-shaped magnet material, the manufacturing apparatus including:

a die having a penetrating hole of a constant diameter (D);

a mandrel accessible through one opening of the die and arranged in the penetrating hole, the mandrel having a cylinder tip portion of a diameter $d_1$, a cylinder base end portion of a diameter $d_2$ (provided $d_1<d_2<D$), and a taper portion positioned between the cylinder tip portion and the cylinder base end portion; and a pressing punch which is accessible through the other opening of the die and whose inner diameter is $d_1$ and whose outer diameter is D.

Furthermore, in order to implement the second manufacturing method described above there is provided a manufacturing apparatus for a ring-shaped magnet material, the manufacturing apparatus including:

a die having a penetrating hole comprised of a first penetrating hole of a diameter $D_1$, a second penetrating hole of a diameter $D_2$ (provided $D_1<D_2$), and a tapered hole positioned between the first penetrating hole and the second penetrating hole;

a mandrel accessible through the second penetrating hole of the die and arranged in the penetrating hole, the mandrel having a cylinder tip portion of a diameter $d_1$, a cylinder base end portion of a diameter $d_2$ (provided $d_1<d_2<D_2$), and a taper portion positioned between the cylinder tip portion and the cylinder base end portion; and a pressing punch which is accessible through the first penetrating hole and whose inner diameter is $d_1$ and whose outer diameter is $D_1$.

BRIEF DESCRIPTION OF THE DRAWINGS

The invention will be described with reference to the accompanying drawings, wherein like numbers refer to like elements, and wherein.

DETAILED DESCRIPTION

At first, the manufacturing apparatus used in the first manufacturing method will be described.

Figure 2:
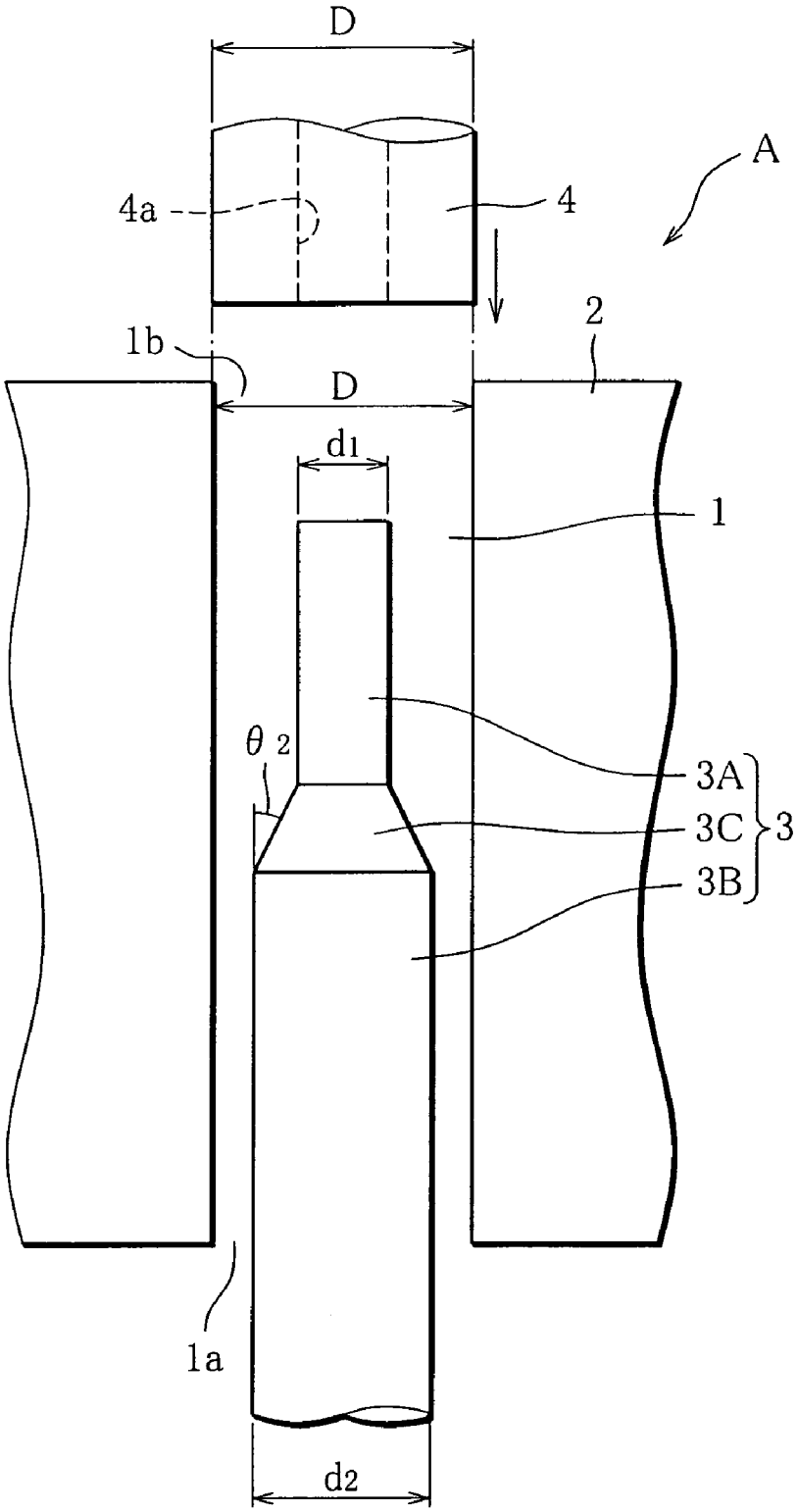
FIG. 2 is an outline schematic view showing a principal part of an example A of manufacturing apparatus of the invention.

FIG. 2 is a conceptual schematic view showing an example A of manufacturing apparatus used in a first manufacturing method.

This apparatus A has a basic configuration including: a die 2 in which a penetrating hole 1 of a constant diameter D is formed in the vertical direction; a mandrel 3 that is coaxially inserted in the penetrating hole from one opening 1*a* (lower part in the drawing) of the penetrating hole 1 and is arranged therein; and a pressing punch 4 which is inserted in the penetrating hole from the other opening 1*b* of the penetrating hole 1 (upper part in the drawing) and which presses a preform to be described hereinafter.

The mandrel 3 comprises a cylinder tip portion 3A of a diameter $d_1$, a cylinder base end portion 3B of a diameter $d_2$ (provided $d_1<d_2<D$), and a taper portion 3C positioned between both. This taper portion 3C is linked with the upper end of the cylinder base end portion 3B of the mandrel, with a gradient of a taper angle $\theta_2$, and the diameter thereof becomes narrower as going toward the lower end of the cylinder tip portion 3A. Accordingly, the diameter of the upper end in the taper portion 3C is $d_1$, and the diameter of the lower end is $d_2$.

In addition, the diameter $d_1$ of the cylinder tip portion 3A described above is the same as the diameter of the penetrating hole formed in the center of the face of a preform to be described later, or is a little smaller than that, so that the cylinder tip portion 3A can intrude into the penetrating hole of this preform.

This mandrel 3, the cylinder base end portion 3B of which is coupled with a mandrel drive mechanism (not shown), is accessible into the penetrating hole 1.

Moreover, a pressing punch 4, the outer diameter of which is substantially the same as the diameter D of the penetrating hole 1, the inner diameter of which is a circular-ring pillar shaped body of substantially the same diameter as the diameter $d_1$ of the cylinder tip portion 3A of the mandrel, and the base end of which is coupled with a pressure device (not shown), is accessible into the penetrating hole 1.

Next, the manufacturing apparatus to be used in the second manufacturing method will be described.

Figure 3:
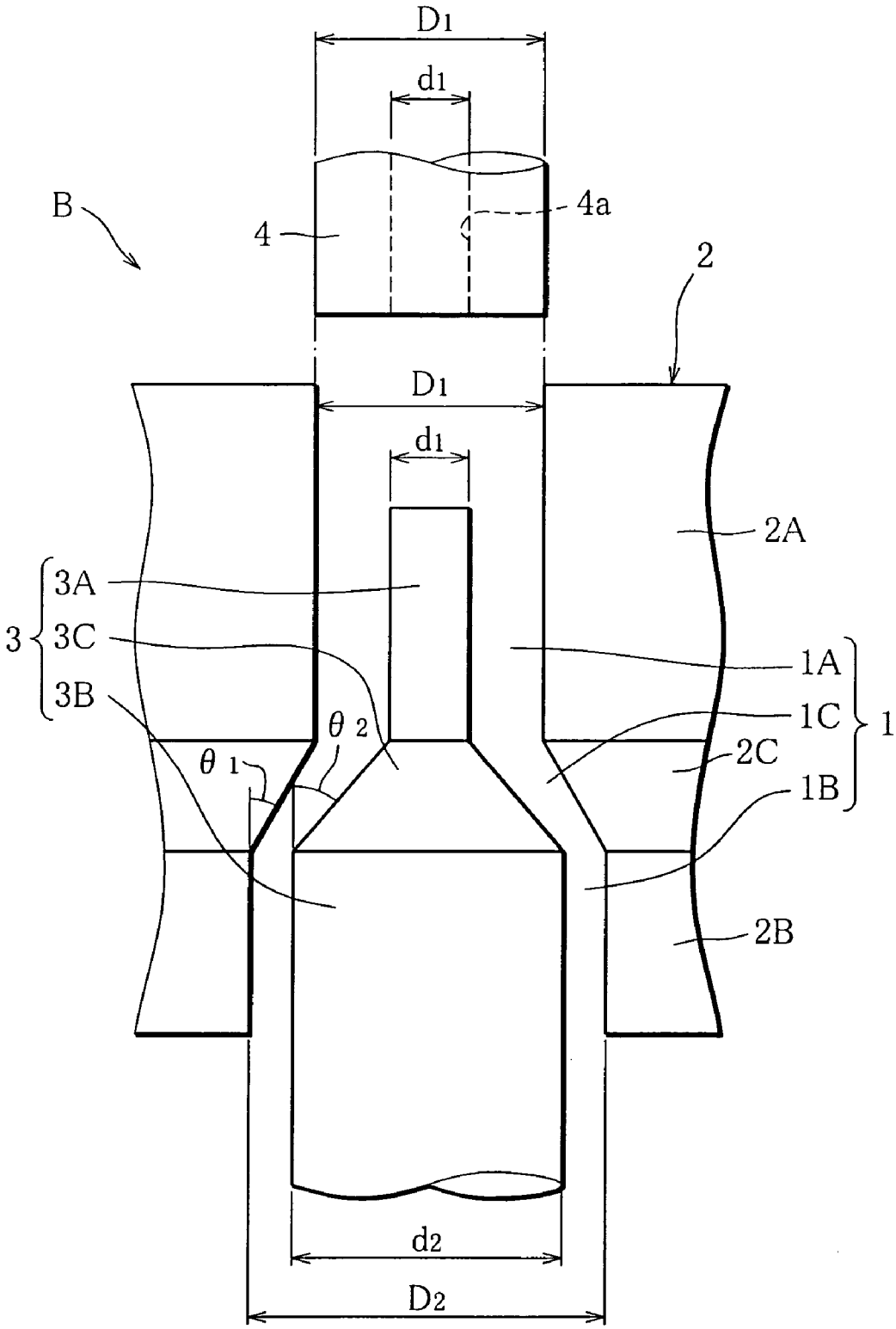
FIG. 3 is an outline schematic view showing a principal part of an example B of manufacturing apparatus of the invention.

FIG. 3 is a conceptual schematic view showing an example B of the manufacturing apparatus.

As for the apparatus B of FIG. 3, the basic configuration including the die 2, the mandrel 3 to be inserted in the penetrating hole 1 and arranged therein, and the pressing punch 4 for pressure-pressing the preform is the same as that of the apparatus A shown in FIG. 2, except that the penetrating hole 1 is in a shape to be described later.

In FIG. 3, in the die 2, the penetrating hole 1 is formed in the vertical direction, and the penetrating hole 1 includes a first penetrating hole (first penetrating hole portion) 1A of a diameter $D_1$, a second penetrating hole (second penetrating hole portion) 1B of a diameter $D_2$ (provided $D_1<D_2$), and a tapered hole (tapered hole portion) 1C positioned between both penetrating holes (penetrating hole portions). Accordingly, the diameter of the upper end in the taper 1C is $D_1$, and the diameter of the lower end is $D_2$.

In addition, it is preferable that the die 2 be configured combining the following three portions: a die portion 2A in which a first penetrating hole 1A is formed; another die portion 2B in which a second penetrating hole 1B is formed; and a die portion 2C in which a taper hole 1C is formed, the die portion 2C being interposed between both die portion 2A and die portion 2B.

In this case, the thickness dimension of the die portion 2C is set to the same dimension as the height dimension of the taper portion 1C of the mandrel.

Here, as shown in FIG. 3, if the taper angle of the tapered hole 1C is denoted by $\theta_1$ (°) and the taper angle of the taper portion 3C of the mandrel is denoted by $\theta_2$ (°), the values of $\theta_1$ and $\theta_2$ are designed as to satisfy the relationship of $\theta_1<\theta_2$.

In the methods according to the present invention, a ring-shaped magnet material is manufactured using these apparatus A and apparatus B, whichever is implemented, the first manufacturing method or the second manufacturing method, at first the following preforming body is manufactured.

For example, a magnet powder of an Nd—Fe—B type is transformed into a green compact with the conventional method, and is further warm-pressed to produce a densified preform of a ring shape.

In implementing the first manufacturing method, extrusion is carried out such that the outer diameter of the preform may be substantially the same as or slightly smaller than the diameter (D) of the penetrating hole 1 of the die 2 in the apparatus A, and the inner diameter may be substantially the same as or slightly larger than the diameter ($d_1$) of a cylinder tip portion 3A of the mandrel 3.

Moreover, in implementing the second manufacturing method, extrusion is carried out such that the outer diameter of the preform may be substantially the same as or slightly smaller than the diameter ($D_1$) of the first penetrating hole 1A of the die 2 in the apparatus B, and the inner diameter may be substantially the same as or slightly larger than the diameter ($d_1$) of the cylinder tip portion 3A of the mandrel 3.

As for the magnetic powder to be used, although not particularly limited to, for example, the one in an Nb—Fe—B type having a composition of Nd: 20 to 40 mass %, Fe: 40 to 70 mass %, Co: 30 mass % or less, B: 0.3 to 3.0 mass % is suitable.

After making the above preparations, the ring-shaped magnet material will be manufactured as follows. This will be described in the case of the first manufacturing method, first.

First, in the apparatus A shown in FIG. 2, the drive mechanism (not shown) is driven, thereby inserting the mandrel 3 into the penetrating hole 1 of the die 2 and arranging it therein.

Then, the preform 5 of a ring shape is inserted from the upper opening 1*b* of the penetrating hole 1 and loaded to the cylinder tip portion 3A of the mandrel 3.

Figure 4:
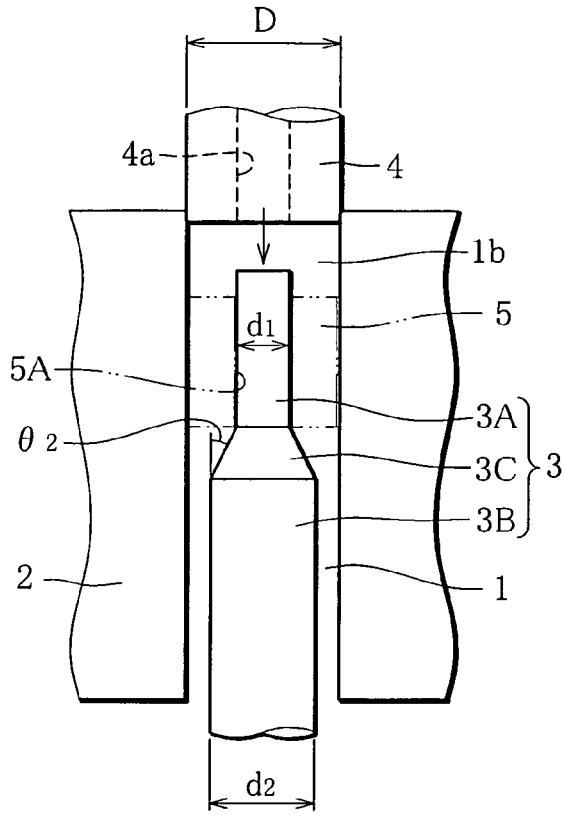
FIG. 4 is an outline view showing a state where the apparatus A is loaded with a preforming body.

At this time, as shown by the virtual line of FIG. 4, the preform 5 is loaded into the mandrel in the state where only the cylinder tip portion 3A intrudes into a penetrating hole 5A thereof but does not intrude into the taper portion 3C.

Next, a pressure mechanism (not shown) is activated to press the above-described preform 5 with the pressing punch 4 as shown by the arrow, thereby carrying out the plastic working.

In the state where the cylinder tip portion 3A of the mandrel is inserted in the penetrating hole 4*a* of the pressing punch 4, the plastic-deformation of the preform 5 is proceeded with the pressing punch 4.

Figure 5:
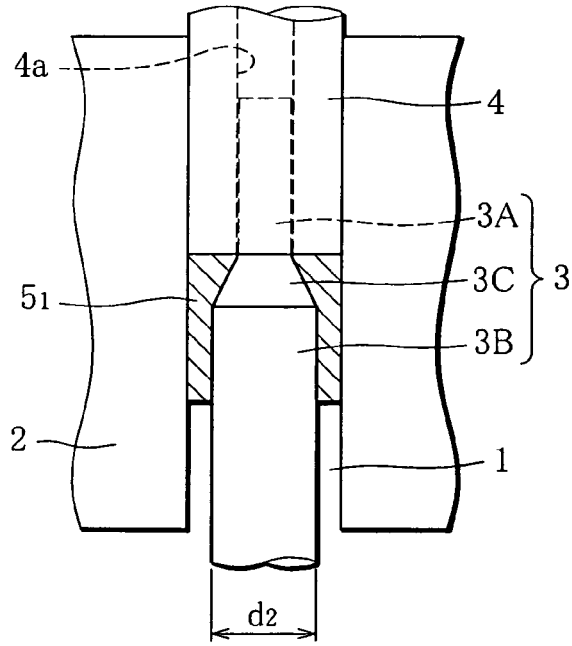
FIG. 5 is an outline view showing a state where the preforming body is pressed with a pressing punch.

The pressing punch 4 descends to the upper end of the taper portion 3C and stops there as shown in FIG. 5, and by this time, the preform 5 is extruded downward in the gap of a circular ring shape which the die 2 and the mandrel 3 form, thereby being transformed into a extrusion $\mathbf{5}_1$ having a cross-section shape as shown in FIG. 5. In addition, because during this process the mandrel is in a two point mounting state supported by the mandrel drive mechanism (not shown) and the pressing punch 4, the core misalignment of the mandrel will not occur.

Figure 6:
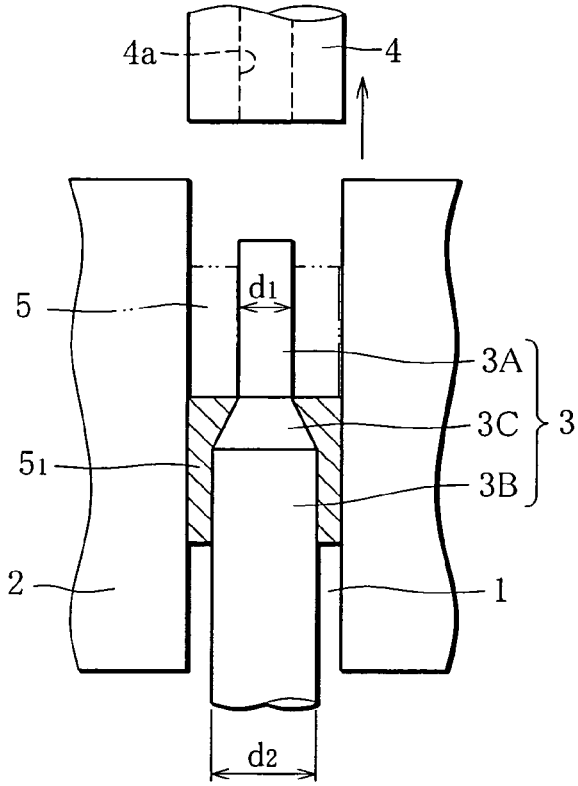
FIG. 6 is an outline view showing a state where the apparatus A is loaded with a new preforming body.

Next, the pressing punch 4 is retreated, and then as shown by the virtual line of FIG. 6, a new preform 5 is loaded into the penetrating hole 1 of the die 2. Then, again, the pressing punch 4 is activated to press the preform 5.

Figure 7:
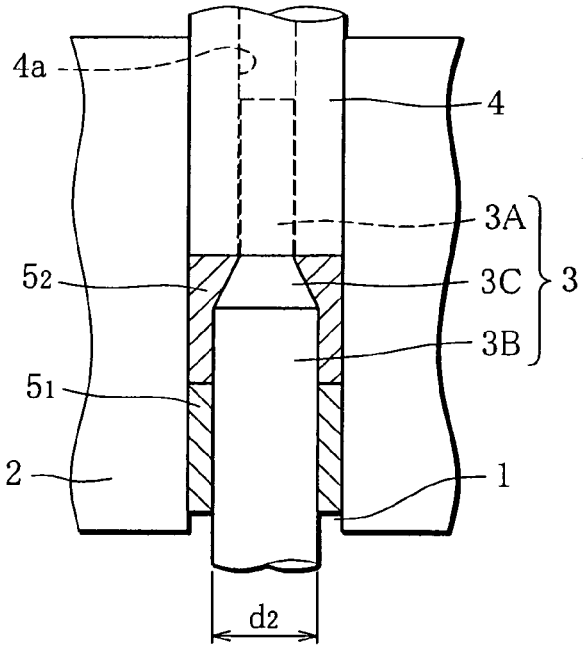
FIG. 7 is an outline view showing a state where the new preforming body is pressed with the pressing punch.

As a result, at the time when the pressing punch 4 descends to the upper end of the taper portion 3C in the mandrel, as shown in FIG. 7, the previous extrusion $\mathbf{5}_1$ is extruded further downward in the penetrating hole 1, and in the gap of a circular ring shape, which the cylinder base end portion 3B of the mandrel and the die 2 form, it is transformed into a ring shape, whose outer diameter is D and whose inner diameter is $d_2$, and on top of this a new extrusion $\mathbf{5}_2$ is formed.

In this way, the magnet material of a ring-shape is continuously extruded by repeating the operations of retreating the pressing punch, loading the new preform, and pressing with the pressing punch.

In this series of operations, when pressed with the pressure punch 4, the preform 5 loaded into the cylinder tip portion 3A of the mandrel is to be plastic-deformed in the state of being squeezed in the gap which the die 2 and the taper portion 3C form. In other words, during the process of being extruded downward in the penetrating hole 1, the preform 5 receives a large deformation-processing sequentially at the position of the taper portion 3C, and after having passed through the taper portion 3C, a state of having received this deformation will be always maintained.

For this reason, in the ring-shaped magnet material $\mathbf{5}_1$ extruded, the tip portion thereof has received a sufficient deformation, and as a result, deterioration of the magnetic properties is also suppressed, and thus the conventional cut of the tip portion will not be required.

Moreover, because the preform 5 to be loaded is in a ring-shape having the penetrating hole 5A whose diameter is substantially the same as the diameter $d_1$ of the cylinder tip portion 3A of the mandrel, the material will be extruded straight downward during the process of pressure-press with the pressing punch 4.

Figure 1:
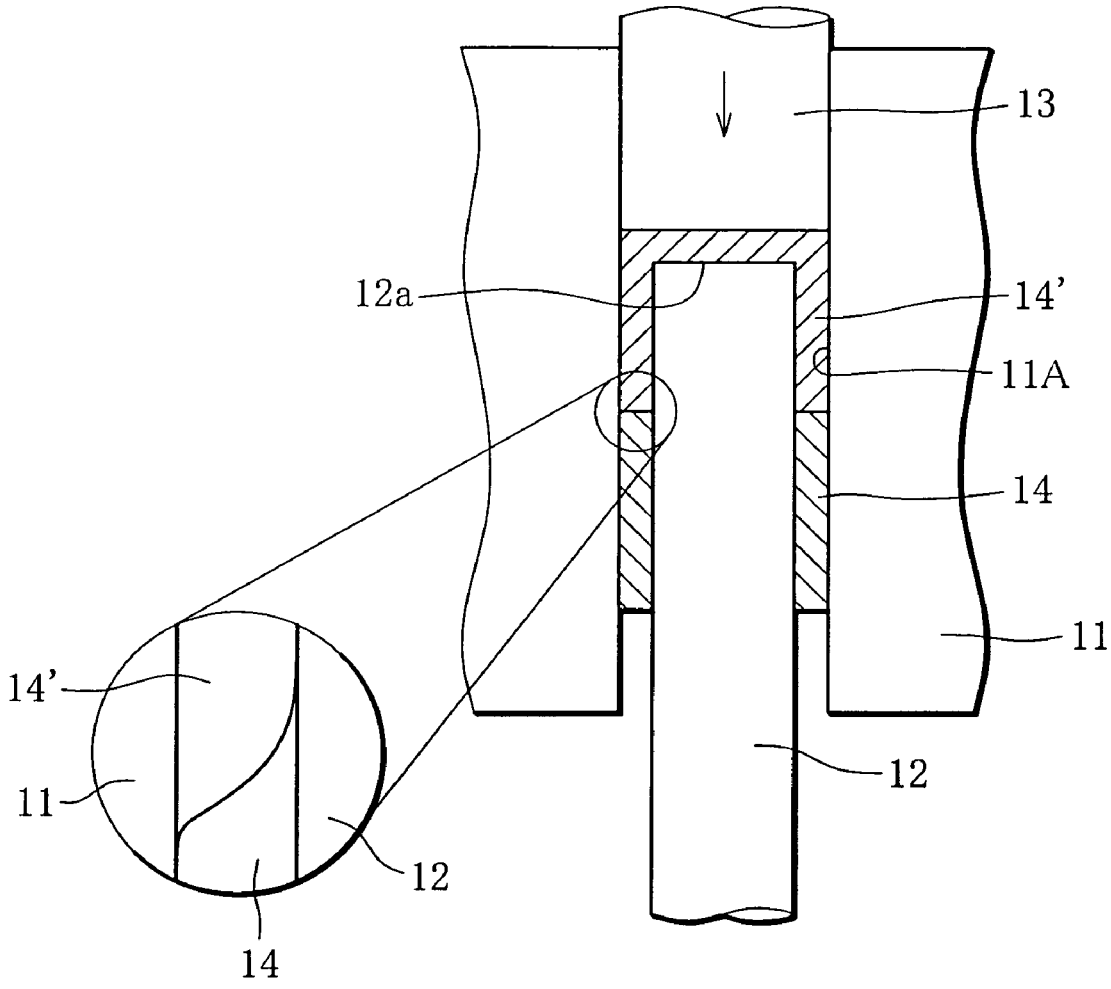
FIG. 1 is an outline view for explaining a conventional continuous molding method.

As a result, in the coupling portion between the extrusion $\mathbf{5}_1$ and the next extrusion $\mathbf{5}_2$, the mutual wraparound phenomenon of the materials like the one shown in FIG. 1 is suppressed, and the mutual end faces are coupled in the state of intersecting at right angles with the longitudinal direction.

Such effect will exhibit significantly, if the taper angle ($\theta_2$) of the taper portion 3C of the mandrel is reduced. For example, if the taper angle ($\theta_2$) is set to approximately 1°, the coupling portion will be coupled in the state where the end face of each extrusion is substantially complete flat (in the state of mutually intersecting at right angles). However, because reducing the taper angle ($\theta_2$) results in that the mandrel 3 becomes extremely long, this taper angle ($\theta_2$) is set within the range of 20° to 80° in the invention. This is because if the taper angle ($\theta_2$) is made larger than 80°, (BH) max of the tip portion of the product deteriorates largely, and the wraparound phenomenon as shown in FIG. 1 can not be neglected, and as a result the length of the cut part of the coupling portion becomes long, thus increasing the yield drop.

Moreover, in this first manufacturing method, by providing the taper portion 3C and at the same time by varying the diameter $d_1$ of the cylinder tip portion 3A, the ring-shaped magnet material with enhanced magnetic properties can be manufactured even if the outer diameter and the inner diameter are the same.

For example, if the outer diameter of the ring-shaped magnet material intended for manufacturing is a constant D and the inner diameter thereof is a constant $d_2$, the outer diameter of the preform 5 used for plastic-working needs to be D. However, the diameter of the penetrating hole 5A of the preform 5 corresponding to the diameter $d_1$ of the cylinder tip portion 3A does not need to be restricted to $d_2$. In other words, it is not necessary to cause the diameter $d_1$ of the cylinder tip portion 3A to agree with the inner diameter $d_2$ of the target product. This is because the inner diameter of the extrusion that is finally obtained just needs to be $d_2$.

Then, the amount of deformation (the reduction in area) is expressed by $100\times(1-(D^2-d_2^2)/(D^2-d_1^2))$ (%), and for example, if $d_1$ is increased, the reduction in area described above will increase. Then, by setting the taper angle ($\theta_2$) of the taper portion 3C within the range described above, the preform 5 will receive a large deformation, thus improving the magnetic properties thereof and at the same time the ring-shaped magnet material having a suitable coupling portion can be extruded continuously.

Moreover, as for the mandrel 3 in this first manufacturing method, the cylinder base end portion 3B thereof is supported by the mandrel drive mechanism, and at the time of plastic-working the preform 5 the cylinder tip portion 3A is constrained in the penetrating hole 4*a* of the pressing punch 4. In other words, because the mandrel is in a two point mounting state, the core misalignment will not occur. Accordingly, the ring-shaped magnet material with high dimension accuracy can be manufactured.

Figure 8:
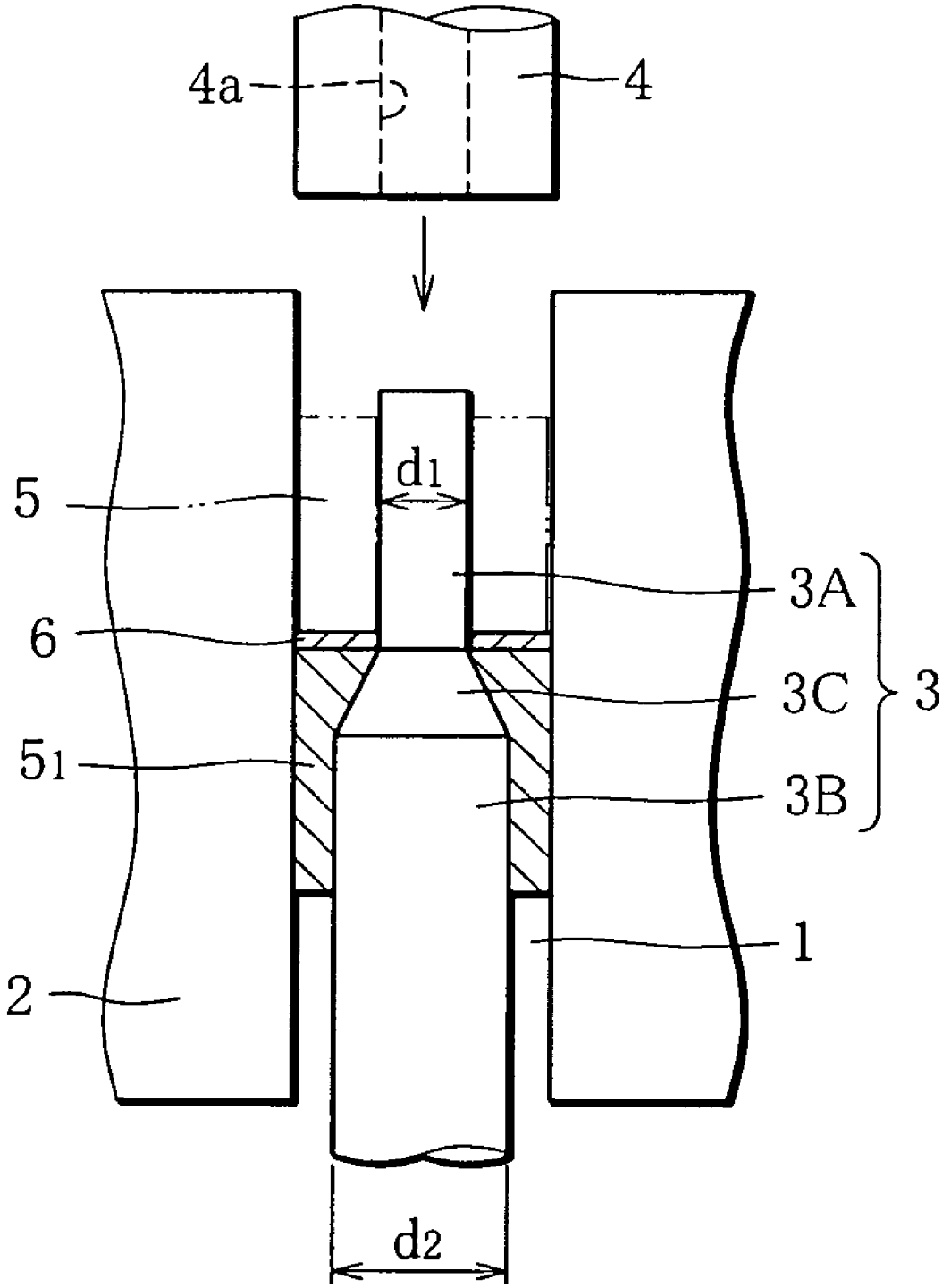
FIG. 8 is an outline view showing a state where a dummy pressure receiver is interposed between the compact which has already been plastic-processed, and a next preforming body.

In addition, as shown in FIG. 8, when loading the extrusion $\mathbf{5}_1$ with the next preform 5, the extrusion $\mathbf{5}_1$ having already been plastic-worked with the pressing punch 4, it is preferable that an iron circular-ring plate 6 be interposed between the extrusion $\mathbf{5}_1$ and the preform 5.

This circular-ring plate 6 functions as a dummy pressure receiver, and adds back pressure to the extrusion $\mathbf{5}_1$ and the preform 5 to thereby preventing the occurrence of microscopic cracks and enhancing the separativeness of the extrusion $\mathbf{5}_1$ and the preform 5.

Especially, in the case where the ring-shaped magnet material is manufactured intended for single taking, this interposing of the dummy pressure receiver is suitable. Note that, in case of continuously manufacturing, this dummy pressure receiver may be or may not be interposed at the time when manufacturing a third magnet material or the subsequent ones.

Figure 9:
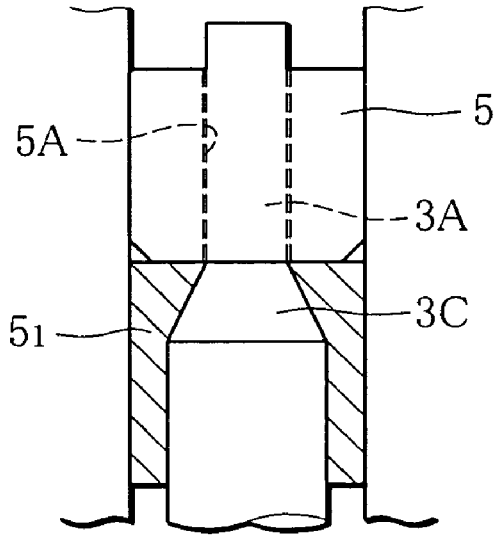
FIG. 9 is an outline view showing a state where a new preforming body whose peripheral corner portion is chamfered is loaded into the apparatus A.

Moreover, as shown in FIG. 9, when loading the next preform 5 on top of the extrusion $\mathbf{5}_1$ to which the plastic-working with the pressing punch has already been carried out, it is preferable that the peripheral corner portion of the bottom of the preform 5 be chamfered in advance. This is because the mutual wraparound phenomenon in the coupling portion between the extrusion $\mathbf{5}_1$ and the preform 5 can be prevented for sure when carrying out the plastic-working with the pressing punch.

Figure 10:
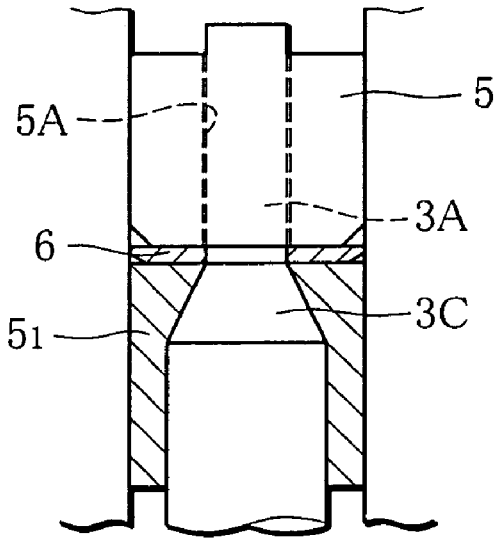
FIG. 10 is an outline view showing a state where a dummy pressure receiver whose peripheral corner portion is chamfered is interposed between a compact which has already been plastic-processed and a new preforming body whose peripheral corner portion is chamfered.

Furthermore, as shown in FIG. 10, if the above-described dummy pressure receiver 6, whose peripheral corner portion has been also chamfered, is interposed between the preform 5 and the extrusion $\mathbf{5}_1$ as shown in FIG. 9, not only the mutual wraparound phenomenon in the coupling portion can be prevented but also the separative work from each other will be carried out extremely easily, which is suitable.

Next, a case of the second manufacturing method will be described.

Figure 11:
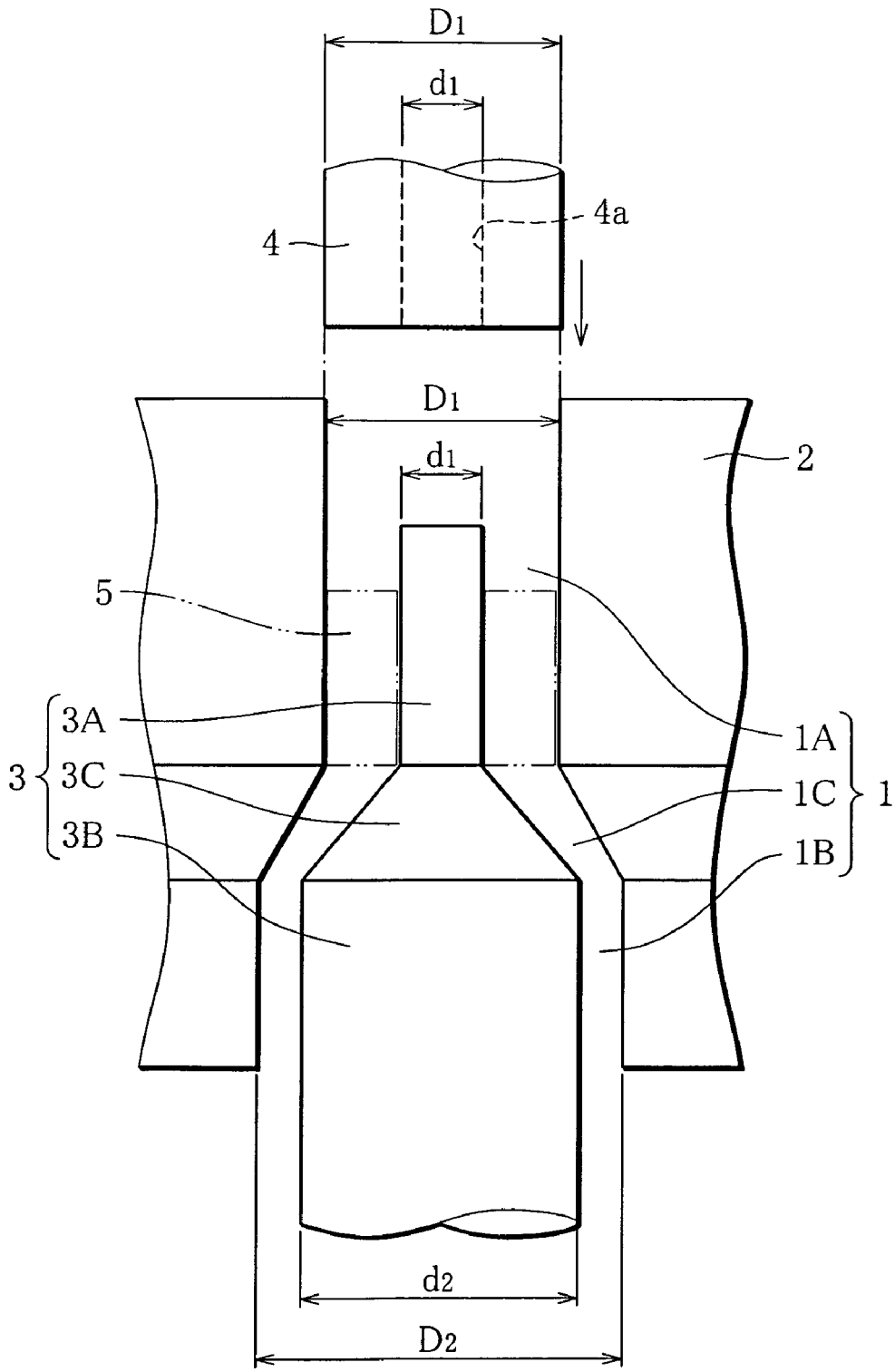
FIG. 11 is an outline view showing a state where the apparatus B is loaded with a preforming body.

As shown in FIG. 11, the mandrel 3 is inserted coaxially into the second penetrating hole 1B of the die 2, and at the position where the upper end and lower end of the taper portion 3C come in agreement with the upper end and lower end of the tapered hole 1C, respectively, the insertion of the mandrel 3 is stopped and the mandrel is arrange and fixed in this position.

As a result, in the first penetrating hole 1A, a circular-ring shaped gap whose width is $(D_1-d_1)/2$ and whose cross sectional area is $(D_1^2-d_1^2)\pi/4$ is formed between the cylinder tip portion 3A and the wall face of the first penetrating hole 1A. Moreover, in the second penetrating hole 1B, a circular-ring shaped gap whose width is $(D_2-d_2)/2$ and whose cross sectional area is $(D_2^2-d_2^2)\pi/4$ is formed between the cylinder base end portion 3B and the wall face of the second penetrating hole 1B.

Then, between the taper portion 3C and the tapered hole 1C, there is formed a gap of a trumpet shape, whose width is $(D_1-d_1)/2$ and whose cross sectional area is $(D_1^2-d_1^2)\pi/4$ at the upper end of the taper portion 3C, and whose width is $(D_2-d_2)/2$ and whose cross sectional area is $(D_2^2-d_2^2)\pi/4$ at the lower end of the taper portion 3C.

In addition, among $D_1$, $d_1$, $D_2$, and $d_2$ the values of $D_1$, $d_1$, $D_2$ and $d_2$, are designed so that the above-described relationship: $D_1<D_2$ and $d_1<d_2<D_2$ may be established, and so that the relationship $(D_2-d_2)<(D_1-d_1)$ may be also established by setting $\theta_1<\theta_2$.

Accordingly, in the above-described gap of a trumpet shape formed between the taper portion 3C and the tapered hole 1C, the cross sectional area of the upper end of the taper portion 3C is larger than the cross sectional area of the lower end.

By establishing the relationship $(D_2-d_2)<(D_1-d_1)$ it is possible to give distortion at the time of plastic-working the preform.

Next, the preform 5 is inserted into the first penetrating hole 1A and loaded on the cylinder tip portion 3A of the mandrel 3. At this time, because the inner diameter and outer diameter of the preform 5 are substantially the same as the diameter of the cylinder tip portion 3A and the diameter of the first penetrating hole 1A, respectively, the preform 5 is arranged in the first penetrating hole 1A in the state of being maintained at the upper end of the taper portion 3C of the mandrel, as shown by the virtual line in FIG. 11.

Next, by driving the pressure device (not shown), the preform 5 is pressed with the pressing punch 4 as shown by the arrow, thereby carrying out the plastic-working.

At this time, the plastic-working of the preform 5 goes on with the pressing punch in the state where the cylinder tip portion 3A of the mandrel is inserted in the penetrating hole 4*a* of the pressing punch 4.

The pressing punch 4 descends in the first penetrating hole 1A, with the cylinder tip portion 3A of the mandrel being as a guide, and finally stops at the upper end of the taper portion 3C.

Figure 12:
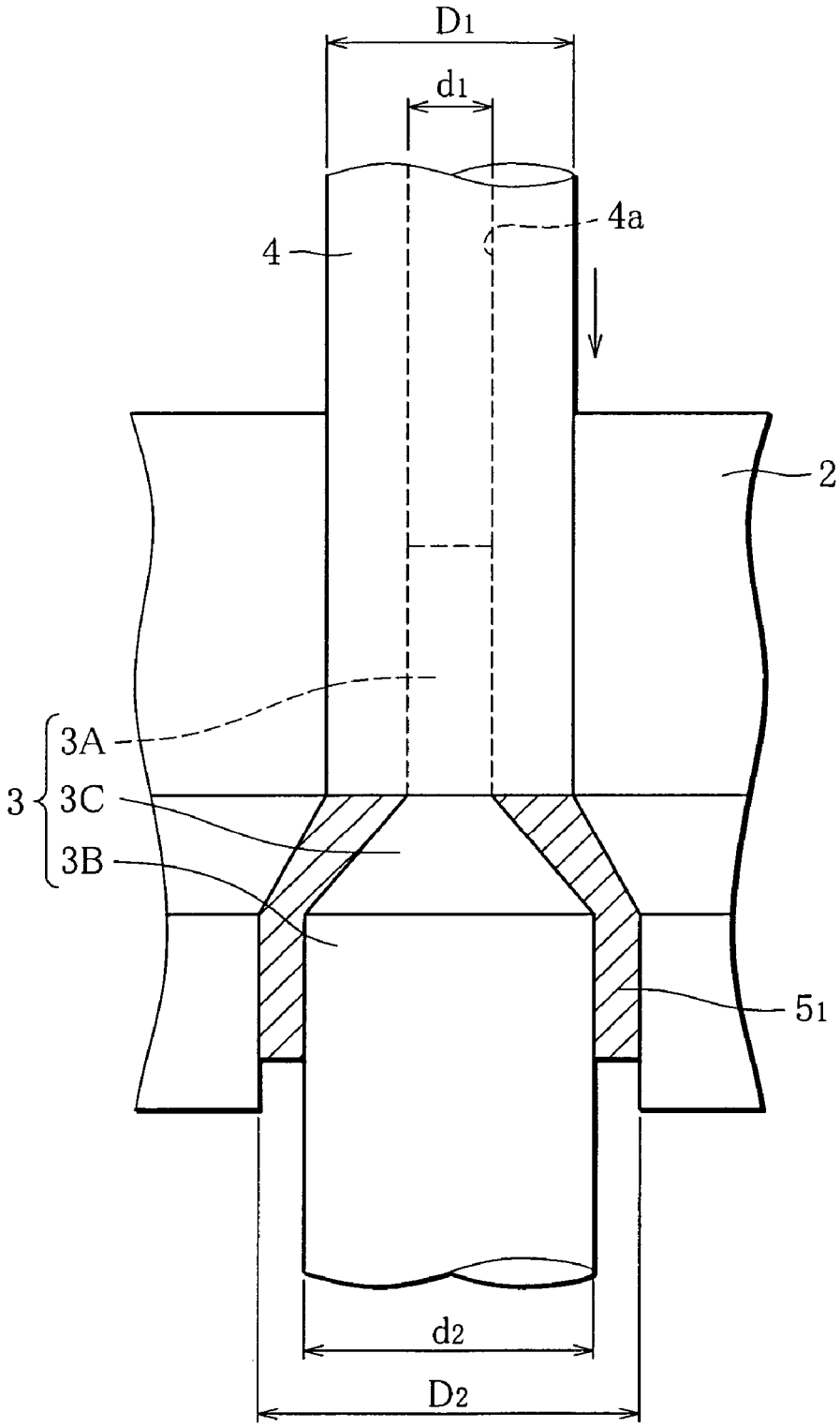
FIG. 12 is an outline view showing a state where the preforming body is pressed with the pressing punch.

Then, during this process, via the inside of the gap of a trumpet shape which the tapered hole 1C of the die 2 and the taper portion 3C of the mandrel form, the preform 5 is extruded toward the gap of a circular ring shape, which the second penetrating hole 1B of the die and the cylinder base end portion 3B of the mandrel form, and is plastic-worked into the extrusion $\mathbf{5}_1$ as shown in FIG. 12.

At this time, as for the gap of a trumpet shape described above, the cross sectional area of the upper end is at its maximum and the cross sectional area of the lower end is at its minimum, so the preform 5 is squeezed down into the circular-ring shape which reduces the area thereof. In other words, the deformation is realized for sure.

In addition, during this process, the mandrel 3 is in a two point mounting conditions supported by the mandrel drive mechanism (not shown) at the cylinder base end portion 3B side and the pressing punch 4, so the core misalignment will not occur.

Figure 13:
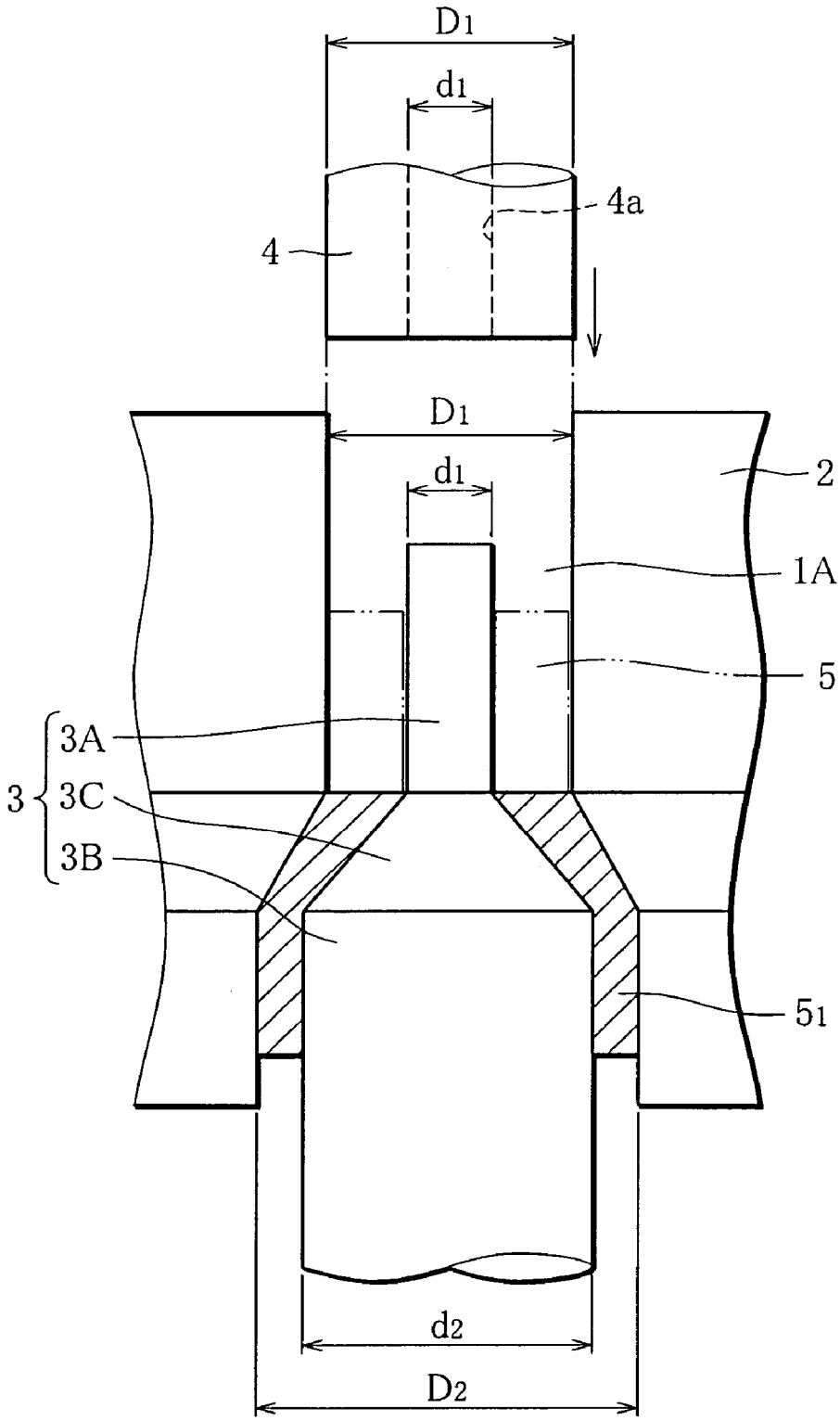
FIG. 13 is an outline view showing a state where the apparatus B is loaded with a preforming body.

Next, the pressing punch 4 is retreated, and then as shown by the virtual line of FIG. 13, a new preform 5 is loaded into the penetrating hole 1A of the die. Then, again, the pressing punch 4 is activated to press the preform 5.

Figure 14:
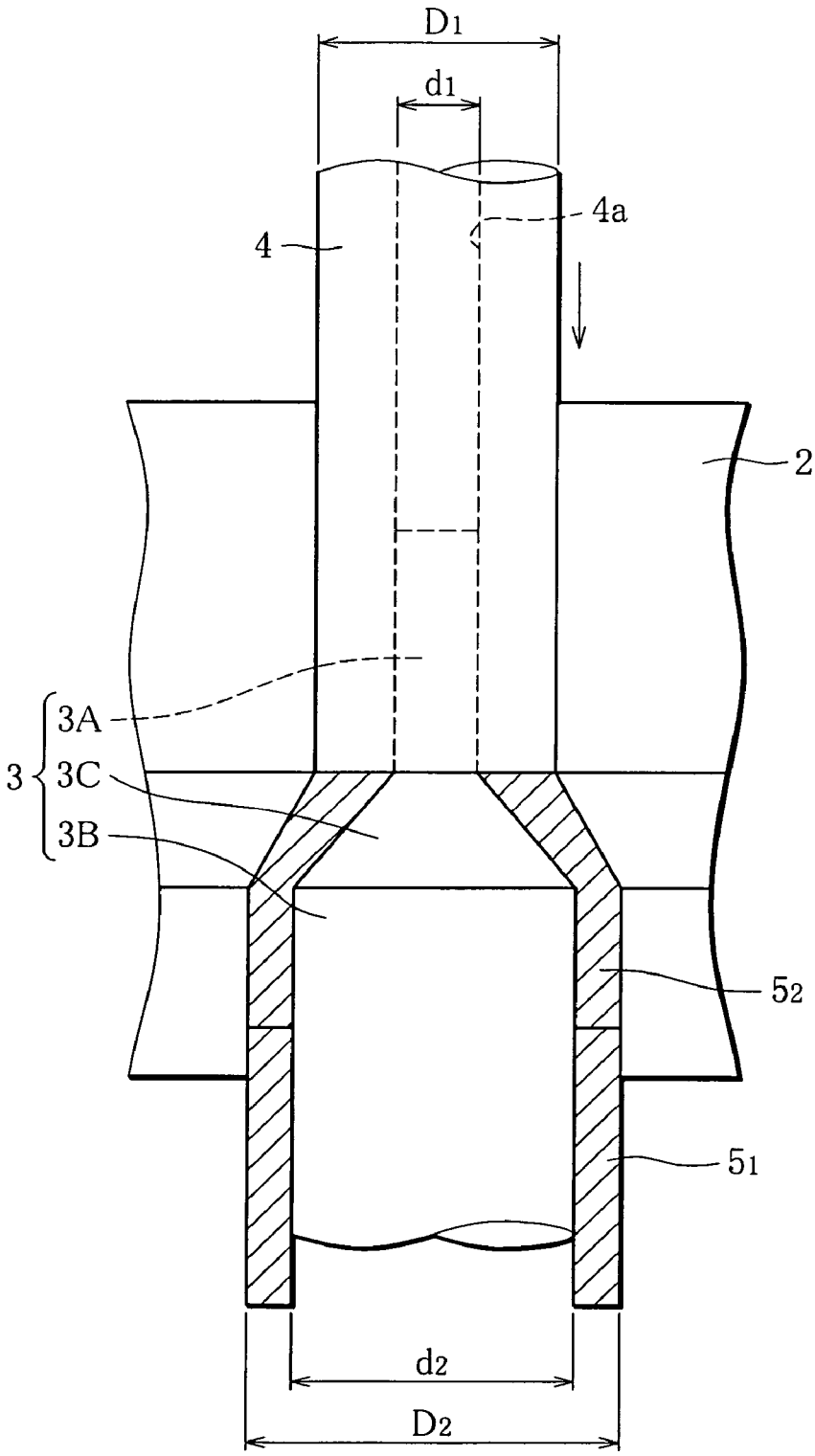
FIG. 14 is an outline view showing a state where the new preforming body is pressed.

As a result, at the time when the pressing punch 4 descends to the upper end of the taper portion 3C, the previous extrusion $\mathbf{5}_1$ will be extruded further downward, as shown in FIG. 14, to be transformed into a perfect circular cylinder shape whose outer diameter is $D_2$ and whose inner diameter is $d_2$, and thus the preform 5 is plastic-deformed into an extrusion $\mathbf{5}_2$ having a shape shown in FIG. 14.

In this way, the ring-shaped magnet material is continuously manufactured by repeating the operations of retreating the pressing punch, loading the new preform, and pressure pressing with the pressing punch.

In the case of the second manufacturing method, because the following relationships $D_1<D_2$, $d_1<d_2$ and $(D_2-d_2)<(D_1-d_1)$ are established, the preform 5 loaded is surely squeezed down to store the distortion during the process of being extruded into the gap which the taper portion 3C and the tapered hole 1C form, and it will receive a deformation through which both the outer diameter and inner diameter of the preform will expand. Then, after having passed through this gap, and during the process of passing through the gap which the cylinder base end portion 3B and the second penetrating hole 1B form, a state of having received this deformation will be always maintained.

For this reason, the magnetic properties of the obtained extrusion (the ring-shaped magnet material) $\mathbf{5}_1$ will improve.

Moreover, because the tip portion thereof also has received sufficient deformation, deterioration of the magnetic properties is also suppressed, and thus the conventional cut of the tip portion will not be required.

Moreover, because the preform to be loaded is in a circular cylinder shape having the penetrating hole whose diameter is substantially the same as the diameter $d_1$ of the cylinder tip portion 3A of the mandrel, the material will be extruded nearly straight downward during the process of the pressure pressing with the pressing punch 4.

As a result, in the coupling portion between the extrusion $\mathbf{5}_1$ and the next extrusion $\mathbf{5}_2$, the mutual wraparound phenomenon of the materials as shown in FIG. 1 will not occur, and the mutual end faces will be coupled in the state of intersecting at right angles with the longitudinal direction.

Such improving effect of the magnetic properties and the suppressing effect of the wraparound phenomenon in the coupling portion are influenced by the magnitude of the taper angle ($\theta_2$) of the taper portion 3C of the mandrel, and the taper angle ($\theta_1$) of the tapered hole 1C of the die, as shown in FIG. 3. In relation to the magnetic properties, these $\theta_1$ and $\theta_2$ are designed in relation to $D_1$, $D_2$, $d_1$, and $d_2$, however, in relation to the wraparound phenomenon of the coupling portion, generally, if the taper angles $\theta_1$ and $\theta_2$ are reduced, the effect thereof will exhibit remarkably. For example, if the taper angle $\theta_2$ of the taper portion 3C is set to approximately 1°, the end face of the coupling portion of each extrusion will be mutually coupled in a substantially perfect flat state (in the state of mutually intersecting at right angles).

However, reducing the taper angle $\theta_2$ results in that the mandrel 3 becomes extremely long and the die 2 also becomes extremely thick accordingly, therefore, in the invention it is preferable that the taper angle $\theta_2$ of the taper portion 3C be set within the range of 20° to 80°, if the relationship to the improving effect of the magnetic properties is included. This is because if this taper angle $\theta_2$ increases over 80°, the wraparound phenomenon as shown in FIG. 1 can not be neglected, and for this reason, the cut part of the coupling portion will be long, thereby increasing the yield drop.

In the case of the second manufacturing method, both the outer diameter $D_1$ and the inner diameter $d_1$ of the preform 5 are expanded to obtain the extrusion $\mathbf{5}_1$ ($\mathbf{5}_2$) of the outer diameter $D_2$ and the inner diameter $d_2$. However, the wall thickness becomes thin from $(D_1-d_1)/2$ to $(D_2-d_2)/2$.

Moreover, the cross sectional area decreases from $(D_1^2-d_1^2)\pi/4$ of the preforming body 5 to $(D_2^2-d_2^2)\pi/4$ of the extrusion $\mathbf{5}_1$.

At this time, in the invention, the values of $D_1$, $d_1$, $D_2$, $d_2$, thus $\theta_1$ and $\theta_2$ are designed so that the outer diameter expansion (%) of the extrusion may become within the range of the value of 0 to 70% (except for 0%) on the basis of the outer diameter of the preform represented by $(1-D_1/D_2)\times 100$, and so that the reduction in area (%) represented by $(1-(D_2^2-d_2^2)/(D_1^2-d_1^2))\times 100$ may become within the range of the value of 30 to 94%.

This is because if even either one of the outer diameter expansion or the reduction in area does not satisfy the above-described value, it is difficult to improve the magnetic properties of the ring-shaped magnet material obtained.

In particular, if the dimensions of the die 2 and the mandrel 3 are designed so that the outer diameter expansion may increase over 70%, or the reduction in area may increase over 90%, not only the problem of the magnetic properties but also at the time of pressure pressing the preform 5, for example, breakage of the pressing punch, mandrel seizing, or the like will occur, which is inconvenient.

In addition, also in this second manufacturing method, it is preferable to implement the same means as that of the case of the first manufacturing method as shown in FIG. 8, FIG. 9, and FIG. 10, because the same effect as that described in the first manufacturing method is obtained.

EXAMPLES 1 TO 4 AND COMPARATIVE EXAMPLE 1

The ring-shaped magnet material was manufactured with the first manufacturing method as follows.

A magnetic alloy composed of Nd: 30.5 mass %, Co:6.0 mass %, B: 0.9 mass %, Ga: 0.6 mass %, and the remainder substantially being Fe, is melted, and rapidly solidified with a single-roll process, thereby being transformed into a thin belt, and thereafter it is crushed to obtain a magnetic powder of a grain size of 300 μm or less.

This powder was pressure-powder molded in the cold, and further, a hot press at temperature of 800° C. and pressure of 196 MPa is carried out under an Ar atmosphere to transform this into a preform with the outer diameter of 23.6 mm, the inner diameter of 13 mm, and the length of 16.3 mm.

On the other hand, the apparatus having a structure shown in FIG. 2 was assembled.

In this apparatus, the diameter D of the penetrating hole 1 of the die 2 is 23.6 mm. Moreover, in the mandrel 3, the diameter $d_2$ of the cylinder base end portion 3B is 18.6 mm, the diameter $d_1$ of the cylinder tip portion 3A is 13 mm, the height is 4.6 mm, and the taper angle $\theta_2$ of the taper portion 3C is approximately 30°.

By loading this apparatus with the preform described above and activating the pressing punch 4 at 800° C., the ring-shaped magnet material with the outer diameter of 23.6 mm, the inner diameter of 18.6 mm, and the length of 30 mm was extruded continuously.

For comparison, the similar magnet material was continuously molded by means of the embodiment according to Japanese Unexamined Patent Publication No. Hei 9-129463.

Accordingly, in the case of Example 1, a plastic-working of the reduction in area of 45.6% ($=((1-(23.6^2-18.6^2)/(23.6^2-13^2))\times 100$) was carried out, and in the case of Comparative example 1, a plastic-working of the reduction in area of 56.3% ($=(1-(24^2-8^2)/24^2)\times 100$) was carried out.

With respect to the continuous extrusion obtained, the condition of the coupling portion of each extrusion was visually observed. In Example 1, the coupling end face of each extrusion is substantially face-connected to each other, and the separation from each other was easy.

On the contrary, in Comparative example 1, the wraparound phenomenon of the materials was observed in the coupling portion of each extrusion, and the separation from each other was difficult.

Next, for each magnet material obtained, (BH) max at a place isolated from the tip portion thereof was measured.

Figure 15:
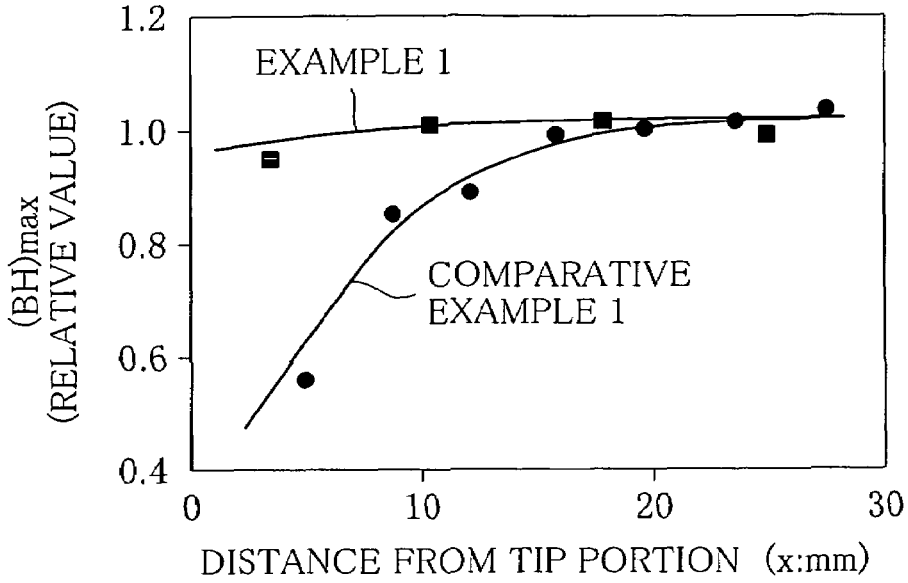
FIG. 15 is a graph showing the relationship between the distance from a tip portion of the magnet material manufactured with the apparatus A, and (BH) max in the place concerned.

Then, the results were normalized with the (BH) max value at the place whose distance from the tip portion in the magnet material of Comparative example 1 is 20 mm, and these are shown in FIG. 15 as the relationship with the distance x (mm) from the tip portion.

As apparent from FIG. 15, in the case of Comparative example 1, (BH) max (the relative value) is 1 at the place 20 mm away from the tip portion, while in Example 1 a place where (BH) max becomes 1 is a place approximately 6 to 7 mm away from the tip portion. Namely, in Example 1, degradation of the magnetic properties in the tip portion is small, and accordingly the length of the cut part is also short, and as a result the yield as the product is high.

On the other hand, magnet materials having the same shape were manufactured as Examples 2, 3, and 4 using three types of mandrels in which the diameter $d_1$ of the cylinder tip portion 3A is set so that the reduction in area in the magnet material to be finally obtained may become 45.6%, 48.9%, and 51.6%.

For comparison, as Comparative example 1, the magnet material having the same shape as that of examples described above was manufactured by means of the embodiment according to Japanese Unexamined Patent Publication No. Hei 9-129463. The reduction in area in this case is 56.3%.

For each magnet material obtained, the relationship between the distance x (mm) from the tip portion and (BH) max in this place was investigated. The results are shown in FIG. 16.

Figure 16:
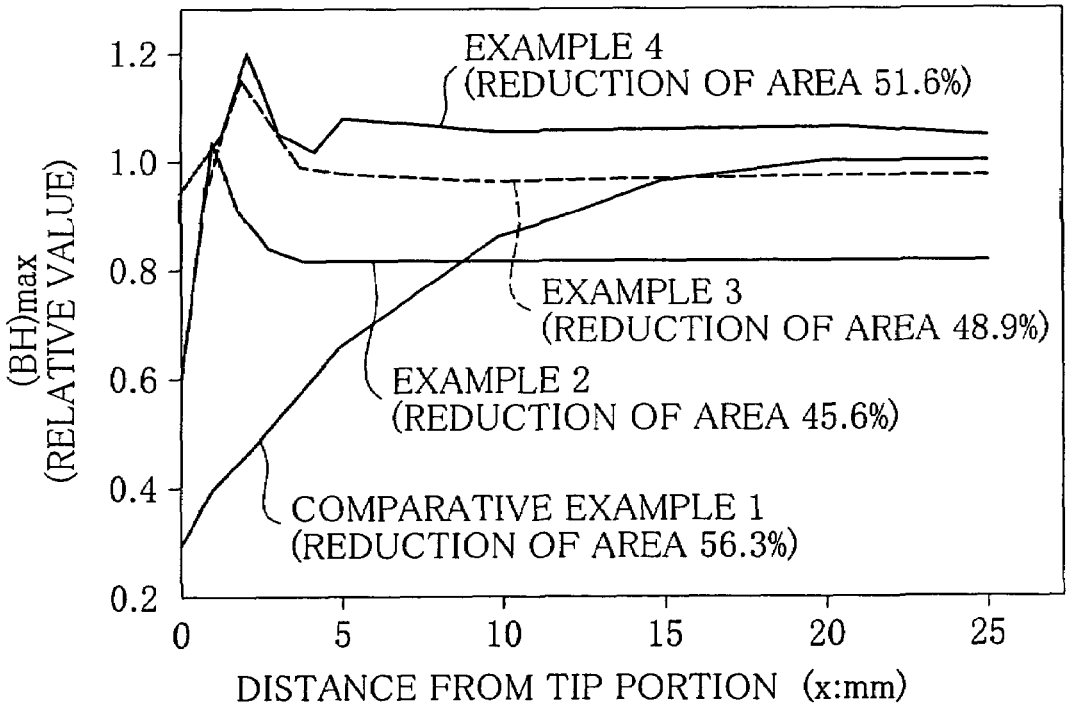
FIG. 16 is a graph showing a relationship between the distance from the tip portion of the magnet material manufactured with the apparatus A in which the diameter of the cylinder tip portion of the mandrel is varied, and (BH) max in the place concerned.

As apparent from FIG. 16, because in Comparative example 1 the reduction in area is fixed for the magnet material of a certain shape, the magnet material having only specific magnetic properties can be manufactured.

On the contrary, in Examples 2, 3, and 4, by varying the diameter $d_1$ in the cylinder tip portion of the mandrel, the magnet material having different magnetic properties can be manufactured even if the overall shape is the same. In particular, by enhancing the reduction in area by decreasing the diameter of the cylinder tip portion $d_1$, the magnet material of high magnetic properties, for example, about 40% higher (BH) max, can be obtained in the state where the length of the cut part of the tip portion is short (with high yield).

EXAMPLES 5 TO 9 AND COMPARATIVE EXAMPLES 2 TO 7

The ring-shaped magnet material was manufactured with the second manufacturing method, as follows.

A plurality of apparatus having the structure shown in FIG. 3 were assembled varying $D_1$, $d_1$, $D_2$, and $d_2$ as shown in Table 1. In addition, the taper angle $\theta_2$ of the taper portion 3C and the taper angle $\theta_1$ of the tapered hole 1C in these apparatus are also shown in Table 1.

On the other hand, a magnetic alloy composed of Nd: 29.5 mass %, Co: 5.0 mass %, B: 0.9 mass %, Ga: 0.6 mass %, and the remainder substantially consisting of Fe is melted and rapidly solidified into ribbons with a single-roll method, and thereafter the ribbons are crushed to obtain the magnetic powder of a grain size of 300 μm or less. Let this be a magnetic powder A.

Moreover, a magnetic alloy composed of Nd: 30.6 mass %, Co: 6.0 mass %, B: 0.89 mass %, Ga: 0.57 mass %, and the remainder substantially consisting of Fe is ingoted, and a magnetic powder of a grain size of 300 μm or less is obtained in the same way as the case of the magnetic powder A. Let this be a magnetic powder B.

In addition, the magnetic powder A is the raw material powder for a magnet having a high remnant magnetization (Br), and the magnetic powder B is the raw material powder for a magnet having a high magnetic coercive force (iHc).

First, the manufacturing apparatus of the structure shown in FIG. 3 having the dimension specification shown in Table 1 was assembled.

On the other hand, the magnetic powders described above were press-powder molded in the cold, respectively, and further under an Ar atmosphere, a hot press is carried out at temperature of 800° C. and at pressure of 196 MPa, thereby manufacturing preform having the geometry shown in Table 1, the preform to be used in each manufacturing apparatus.

TABLE 1

| | Die | | | Mandrel | | | Geometry of preform | | | |
|---|---|---|---|---|---|---|---|---|---|---|
| | Diameter of first penetrating hole ($D_1$, mm) | Diameter of second penetrating hole ($D_2$, mm) | Taper angle of tapered hole ($\theta_1$: °) | Diameter of cylinder tip portion ($d_1$, mm) | Diameter of cylinder base end portion ($d_2$, mm) | Taper angle of taper portion ($\theta_2$, mm) | Type of magnetic powder used | Outer diameter (mm) | Inner diameter (mm) | Height (mm) |
| Example 5 | 33.0 | 39.0 | 6.9 | 5.0 | 33.5 | 30 | A | 33.0 | 5.0 | 18.7 |
| Example 6 | 33.0 | 39.0 | 6.9 | 5.0 | 33.5 | 30 | B | 33.0 | 5.0 | 18.7 |
| Example 7 | 150.0 | 300.0 | 19.8 | 50.0 | 290.0 | 30 | B | 150.0 | 50.0 | 29.5 |
| Example 8 | 8.2 | 9.5 | 8.5 | 2.0 | 7.0 | 30 | A | 8.2 | 2.0 | 32.6 |
| Example 9 | 30.0 | 39.0 | 10.5 | 10.0 | 38.0 | 30 | A | 30.0 | 10.0 | 19.3 |
| Comparative example 2 | 39.0 | 39.0 | 0 | 13.0 | 33.5 | 30 | A | 39.0 | 13.0 | 14.7 |
| Comparative example 3 | 39.0 | 39.0 | 0 | 13.0 | 33.5 | 30 | B | 39.0 | 13.0 | 14.7 |
| Comparative example 4 | 53.0 | 39.0 | −15.8 | 27.0 | 33.5 | 30 | A | 53.0 | 27.0 | 10.0 |
| Comparative example 5 | 39.0 | 39.0 | 0 | 32.0 | 33.5 | 30 | A | 39.0 | 32.0 | 40.1 |
| Comparative example 6 | 10.5 | 39.0 | 26.5 | 5.0 | 38.0 | 30 | A | 10.5 | 5.0 | 180.8 |
| Comparative example 7 | 39.0 | 39.0 | 0 | 5.0 | 38.0 | 30 | A | 39.0 | 5.0 | 10.3 |

Next, each preform is loaded into each manufacturing apparatus, and by activating at 800° C. the pressing punch the ring-shaped magnet materials having the geometry shown in Table 2 were extruded continuously. For each ring-shaped magnet material obtained, the maximum energy product ((BH) max: kJ/m$^3$), the remnant magnetization (Br: T), and the magnetic coercive force (iHc: kA/m) form the IH curve were measured.

The results together with the outer diameter expansion (%) and the reduction in area (%) at the time of molding are shown in Table 2.

TABLE 2

| | Die | | Ring-shaped magnet materials | | | | | |
|---|---|---|---|---|---|---|---|---|
| | | | Geometry | | | Magnetic properties | | |
| | Outer diameter expansion (%: (1 − $D_1/D_2$) × 100) | Reduction in area (%: (1 − $(D_2^2 - d_2^2)/(D_1^2 - d_1^2)$) × 100 | Outer diameter (mm) | Inner diameter (mm) | Height (mm) | (BH)max: kJ/m$^3$ | Br: T | iHc: kA/m |
| Example 5 | 15 | 62 | 39.0 | 33.5 | 50.0 | 400 | 1.45 | 1220 |
| Example 6 | 15 | 62 | 39.0 | 33.5 | 50.0 | 340 | 1.30 | 1860 |
| Example 7 | 50 | 71 | 300.0 | 290.0 | 100.0 | 335 | 1.29 | 1850 |
| Example 8 | 14 | 34 | 9.5 | 7.0 | 50.0 | 350 | 1.38 | 1270 |
| Example 9 | 23 | 90 | 39.0 | 38.0 | 200.0 | 402 | 1.45 | 1225 |
| Comparative example 2 | 0 | 71 | 39.0 | 33.5 | 50.0 | 320 | 1.35 | 1230 |
| Comparative example 3 | 0 | 71 | 39.0 | 33.5 | 50.0 | 270 | 1.21 | 1850 |
| Comparative example 4 | −36 | 81 | 39.0 | 33.5 | 50.0 | 290 | 1.28 | 1210 |
| Comparative example 5 | 0 | 20 | 39.0 | 33.5 | 50.0 | 120 | 0.93 | 1320 |
| Comparative example 6 | 73 | 10 | 39.0 | 38.0 | 200.0 | Unable to extrude due to breakage of pressing punch. | | |
| Comparative example 7 | 0 | 95 | 39.0 | 38.0 | 200.0 | Unable to extrude because mandrel seizing occurred. | | |

From Table 1 and Table 2 the followings are understood easily.

Comparing Example 5 with Comparative example 2, both using the same magnetic powder A, the ring-shaped magnet material having mutually the same geometry is extruded by expanding the outer diameter of the preform in Example 5, but by not expanding the diameter in Comparative example 2. However, in spite that the reduction in area of Example 5 is smaller than the reduction in area of Comparative example 2, the (BH) max of the ring-shaped magnet material obtained improves significantly, and Br is also a high value. Similarly, in Example 6 and Comparative example 3, both using the magnetic powder B, both iHc and Br are consistent with each other at high values in Example 6 in contrast with Comparative example 3.

As described above, according to the present invention, it is possible to manufacture magnets having excellent magnetic properties in a large range from a high (BH) max to a high iHC region.

Moreover, as apparent by contrasting Example 5, Comparative example 2 and Comparative example 4, even if the geometries of the ring-shaped magnet material extruded are the same, Comparative example 4 manufactured by reducing the outer diameter of the preform is inferior in the (BH) max above all the magnetic properties as compared with Comparative example 2, despite that Comparative example 4 is manufactured with a large reduction in area.

Moreover, although Comparative example 5 is a case example of being plastic worked with a small reduction in area, in this case iHC retains the value close to the magnetic coercive force of the unworked preform, however Br and (BH) max are low and do not attain the values required for the product.

While Example 7 is a case example where the present invention has been applied to a large size product and Example 8 is a case example where the present invention has been applied to a small size product, in both cases excellent magnetic properties are obtained. Form this fact, it is understood that the present invention is useful as the method for manufacturing magnet material having excellent magnetic properties in a large range also in terms of dimension.

Example 9, Comparative example 6 and Comparative example 7 all are case examples of manufacturing thin-walled products which are difficult to be extruded.

While Comparative example 6 is a case example where the extrusion is carried out at the reduction in area of 10% and at the outer diameter expansion of 73%, the extrusion was not possible because the pressing punch could not withstand the extrusion load and was broken.

While Comparative example 7 is the case example where the extrusion is carried out at reduction in area of 95% and at the outer diameter expansion of 0%, the extrusion was also not possible because the expansion at the inner diameter side was too large for a lubricant film applied to follow the above expansion, thereby causing the mandrel seizing.

On the other hand, in Example 9, because the extrusion is carried out at the reduction in area of 90% and at the outer diameter expansion of 23%, and the degree of processing of the inner and outer diameter is dispersed, the extrusion is possible without causing the breakage of the pressing punch and the mandrel seizing, and moreover it is possible to manufacture magnet materials having excellent magnetic properties.

As such, in order to enhance (BH) max above all the magnetic properties of the ring-shaped magnet material, it is understood that it is effective to carry out extruding as to expand the inner and the outer diameter of the preform to be used.

In addition, for the continuous extrusion obtained, the condition of the coupling portion of each extrusion was visually observed. In any case of Examples and Comparative examples, the coupling end face of each extrusion is substantially face-connected to each other, and the separation from each other was also easy.

In addition, in any case of Examples, deterioration of the (BH) max in the tip portion thereof were suppressed, and the value of (BH) max were set within the range of no problem in practical use.

What is claimed is:

1. A method for manufacturing a ring-shaped magnet, the method comprising:

arranging, in a penetrating hole formed in a die, a mandrel comprising a cylinder tip portion of a diameter $d_1$, a cylinder base end portion of a diameter $d_2$, and a taper portion of a taper angle $\theta_2$ positioned between the cylinder tip portion and the cylinder base end portion, wherein said penetrating hole comprises a first penetrating hole portion of a diameter $D_1$, a second penetrating hole portion of a diameter $D_2$, provided $D_1<D_2$, and a tapered hole portion of a taper angle $\theta_1$ positioned between the first penetrating hole portion and the second penetrating hole portion;

loading the cylinder tip portion with a preform from which the ring-shaped magnet is to be made, the preform being a circular ring column shaped body having an inner diameter of $d_1$; and plastic-working the preform in a gap formed by the penetrating hole and the mandrel, by pressing the preform with a pressing punch having an inner diameter of $d_1$ and an outer diameter of $D_1$;

wherein $D_1$, $D_2$, $d_1$ and $d_2$ have values that satisfy:

$$d_1<d_2<D_2,$$

$$0<(1-D_1/D_2)\times 100\leqq 70, \text{ and}$$

$$30\leqq(1-(D_2^2-d_2^2)/(D_1^2-d_1^2))\times 100\leqq 94.$$

2. The method according to claim 1, wherein the taper angle $\theta_1$ of the tapered hole portion and the taper angle $\theta_2$ of the taper portion of the mandrel satisfy $\theta_1<\theta_2$ and $20°\leqq\theta_2\leqq 80°$.

3. The method according claim 1, wherein the ring-shaped magnet is manufactured continuously in the gap formed by the penetrating hole and the mandrel.

4. The method according to claim 2, wherein the ring-shaped magnet is manufactured continuously in the gap formed by the penetrating hole and the mandrel.

5. The method according claim 1, wherein a dummy pressure receiver having a circular-ring shape is inserted between the pressing punch and the preform, and the plastic-working is carried out on the preform while applying back pressure.

6. The method according to claim 2, wherein a dummy pressure receiver having a circular-ring shape is inserted between the pressing punch and the preform, and the plastic-working is carried out on the preform while applying back pressure.

7. The method according to claim 3, wherein a dummy pressure receiver having a circular-ring shape is inserted between the pressing punch and the preform, and the plastic-working is carried out on the preform while applying back pressure.

8. The method according to any one of claims 1 or 2 to 7, wherein a peripheral corner portion of the preform is chamfered.

9. An apparatus for manufacturing a ring-shaped magnet, comprising:

a die having a penetrating hole comprising a first penetrating hole portion of a diameter $D_1$, a second penetrating hole portion of a diameter $D_2$, provided $D_1<D_2$, and a tapered hole portion of a taper angle $\theta$ positioned between the first penetrating hole portion and the second penetrating hole portion;

a mandrel inserted in the penetrating hole of the die through the second penetrating hole portion, the mandrel comprising a cylinder tip portion of a diameter $d_1$, a cylinder base end portion of a diameter $d_2$, and a taper portion of a taper angle $\theta_2$ positioned between the cylinder tip portion and the cylinder base end portion; and a pressing punch which is insertable into the penetrating hole of the die through the first penetrating hole portion and which has an inner diameter of $d_1$ and an outer diameter of $D_1$;

wherein $D_1$, $D_2$, $d_1$ and $d_2$ have values that satisfy:

$$d_1<d_2<D_2,$$

$$0<(1-D_1/D_2)\times 100\leqq 70, \text{ and}$$

$$30\leqq(1-(D_2^2-d_2^2)/(D_1^2-d_1^2))\times 100\leqq 94.$$

10. The apparatus according to claim 9, wherein the taper angle $\theta_1$ of the tapered hole portion and the taper angle $\theta_2$ of the taper portion of the mandrel satisfy $\theta_1<\theta_2$ and $20°<\theta_2<80°$.

* * * * *